US005297681A

United States Patent [19]

Gourley

[11] Patent Number: 5,297,681

[45] Date of Patent: Mar. 29, 1994

[54] COMBINED CAN STACKER/ADVERTISING DEVICE

[76] Inventor: Mervin D. Gourley, 40247 177th St. East, Palmdale, Calif. 93550

[21] Appl. No.: 70,048

[22] Filed: Jun. 1, 1993

Related U.S. Application Data

[63] Continuation-in-part of Ser. No. 569,977, Aug. 20, 1990, abandoned.

[51] Int. Cl.[5] ..... B65D 21/02

[52] U.S. Cl. ..... 206/503; 206/821; 220/23.83

[58] Field of Search ..... 220/23.4, 23.83, 630; 206/821, 503

[56] References Cited

U.S. PATENT DOCUMENTS

| | | | |
|---|---|---|---|
| 1,757,192 | 5/1930 | Hothersall | 220/4.27 X |
| 2,326,414 | 8/1943 | Thompson | 220/4.27 |
| 2,576,725 | 11/1951 | Schoelles | 206/821 X |
| 2,687,231 | 8/1954 | Somers | 206/821 X |
| 2,766,891 | 10/1956 | Elzer | 206/821 X |
| 2,912,139 | 11/1959 | Talley | 206/821 X |
| 3,198,713 | 8/1965 | McCormick | 215/10 X |
| 3,317,087 | 5/1967 | Landis | 206/821 X |
| 3,482,724 | 12/1969 | Heaton | 215/10 |
| 3,751,082 | 8/1973 | Somerville | 220/23.83 X |
| 3,885,674 | 5/1975 | Westenrieder | 206/503 |
| 4,308,952 | 1/1982 | Paulucci | 206/821 X |
| 4,377,231 | 3/1983 | Murphy | 206/821 X |
| 4,593,818 | 6/1986 | Schenkman | 206/821 X |
| 4,930,636 | 6/1990 | Meadows | 206/503 |

*Primary Examiner*—Steven M. Pollard

*Attorney, Agent, or Firm*—Samuel Shipkovitz

[57] ABSTRACT

A combined can stacker and spatial media advertising-/instructional device facilitating the vertical stacking of similar plan-view shape cans two-at-a-time while also providing space on the panel side(s) of the device for either advertising or for instructions, such as, for example, securing two binary chemical cans together and providing instructions as to the proper mixing of said binary chemicals. For specific example, to provide instructions as to mixing car body compound contained in one first can with hardener contained in the second can, where the two cans are secured to each other with the device to form one vertically integral physical unit. Additional embodiments include having a section having a slot enterable from the top and having a windowed front within which replaceable indicia may be inserted, or a section having a frame of 3 sides molded onto the front within which indicia may be inserted into the open end of such a slideable indicia panel holder (such slide holder being enterable either by having a vertical or horizontal open end). Also a detachable indicia panel for information, coupons and the like can be connected to a section. For multiple page indicia, a pocket for inserting same can be thermoplastically or otherwise attached to a section. Additionally, the indicia may be formed during manufacture on a section or panel and thus provide a 3-dimensional effect (3-D).

10 Claims, 3 Drawing Sheets

COMBINED CAN STACKER/ADVERTISING DEVICE

This is a continuation-in-part of application Ser. No. 569,977 filed Aug. 20, 1990 by the same inventor, Mervin D. Gourley, now abandoned.

BACKGROUND OF THE INVENTION

The present invention relates to devices which both enable standard size cans or jars to be stacked vertically as well as provide a spatial medium for advertising or other message to be displayed to a consumer. Identical content cans can be adhered together two-at-a-time with this device or cans of identical lids but different contents can be adhered together two-at-a-time. For example, fiberglass autobody repair material can be in one can and its related chemical hardener in a second can, both with identical circumference/plan-shaped top and bottom and secured together with the device encompassed by the herein invention and having the brand name logo and/or instructions on the side of the device. Can stacking devices of minimal sides have been the objective and disclosure teachings of prior art in this area. Such adapters for adhering a plurality of cans together in selected configurations are shown in U.S. Pat. Nos. 4,593,818, 4,502,447, 2,912,139, 2,607,231, 1,757,192, German Offenlegungschrift 2,000,371 (FIGS. 1,2), Australia 236,771, UK 2,029,802, U.S. Pat Nos. 2,963,194, 4,415,077, 4,377,231 and 3,624,789. Can stackers generally are utilized where cans are assembled end-to-end with back-to-back/top-to-bottom/top-to-top/bottom-to-bottom adapters performing the adhering or securing of the cans to form a unitary physically secure unit (for example, a pallet unit). Thus, in general, the adapters engage the opposing rims of cylindrical cans and hold them solidly one upon the other. In the three known ring-type can stacker patents, U.S. Pat. Nos. 1,757,192, 2,912,139 and 4,593,818, various tab-like side pieces emanate inwardly from the ring and perform a gripping action on the engaging can. In the first two references cited, the devices are composed of somewhat flexible sheet metal while the third is composed of a flexible resilient split ring of elastic memory-retaining material such as rubber or plastic, with a member of separate, spaced generally-horizontal fins adapted collectively to hold and support a can.

In all of these prior art inventions, the vertical height of the side fins, vertical ring edge, or side tabs was designed to be as short as possible; most probably to permit the storage of the maximum number of these (can-stacker) devices in as small a volume as practicable. Thus, only the can stacking utility of these devices was their inventors' sole objective. Higher sides also add to the stability of the device when mechanical motion becomes involved (for example, an earthquake). However, in the present age of binary-chemical packaging or every form of overt or subliminal advertising, there is a need: to ensure that the consumer knows what product he is buying or should buy or directions to ensure a proper result in the case of multiple cans of distinct materials which under proper preparation and mixing produce a desired chemical product of reaction. The advertising-can-stacking device should be inexpensive, durable, simple and effective. Jars or other containers are within the meaning of the term "can" used in the description and claims of this invention.

SUMMARY OF THE INVENTION

The advertising/can stacker device of the present invention satisfies all of the foregoing needs. It is a simple unitary structure, durable and inexpensively molded of flexible, resilient, elastic memory-retaining material such as plastic, or natural or synthetic rubber or equivalent. It is in the form of a flexible ring having a certain minimum height along its entire circumference with certain widths of said minimal height alternating with side panels that go both significantly below and above the midway of said minimal height to form side panels usable for both securing a lower can placed in the ring to an upper can, as well as to provide an advertising media/instruction space. Since the side panel sections go both below and above the minimal height belt of the ring, this provides additional support for securing the two cans together and in position as compared to the alternating tab sidewalls shown in the prior art, such as in U.S. Pat. No. 1,757,192. As it has no horizontal tabs in one embodiment, it can be more easily manufactured as *either* a stamping or from a simple mold. Due to the three-dimensional nature of those devices having both vertical and horizontal support and/or separating means, the associated manufacturing complexity and associated expense of such three-dimensional molds and molding machines is eliminated for one embodiment of the instant invention.

Further, due to the use of resilient plastic as its material, the stacker ring can be used for any shape can: circular, oblong, rectangular or whatever irregular shape that has a specific circumference. The can stacker flexes and can follow the irregular curvature of the can rims placed therein. The side panels can have advertising, such as corporate logos, etc.; or, for binary chemicals whose can or jars are secured to each other by the device of the invention, the side panels can have detailed instructions thereon.

Thus, one object of the invention is to facilitate the secure storage of cans vertically to preserve horizontal shelf space.

A second object of the invention is to provide an advertising media space not known before, to display advertising or visual instructions to a consumer.

A third object of the invention is to facilitate the use of a single device of the invention to secure two cans vertically two-at-a-time regardless of plan shape but with the same plan view shape and circumference (i.e. for a specific circumference only one device is needed for the same plan view (shape) of the cans.

BRIEF DESCRIPTION OF THE DRAWING

A better understanding of the present invention may be had from the following detailed text description with the accompanying figures of the drawing in which:

FIG. 8B shows a plan view of the device of FIG. 8A, while

DESCRIPTION OF THE PREFERRED EMBODIMENTS

Figure 1:
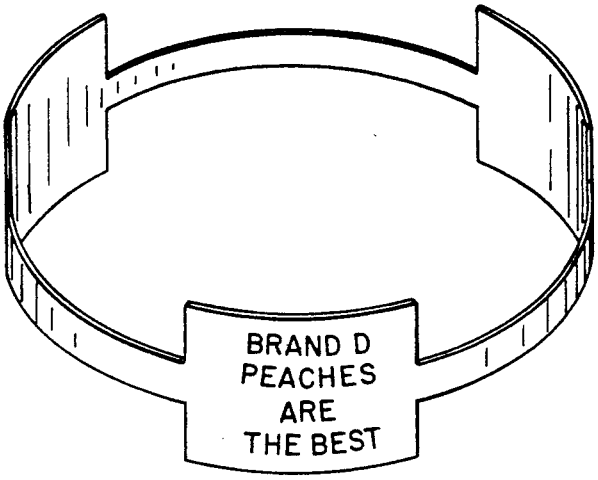
FIG. 1 is a perspective view of a first embodiment of the invention.
Figure 2:
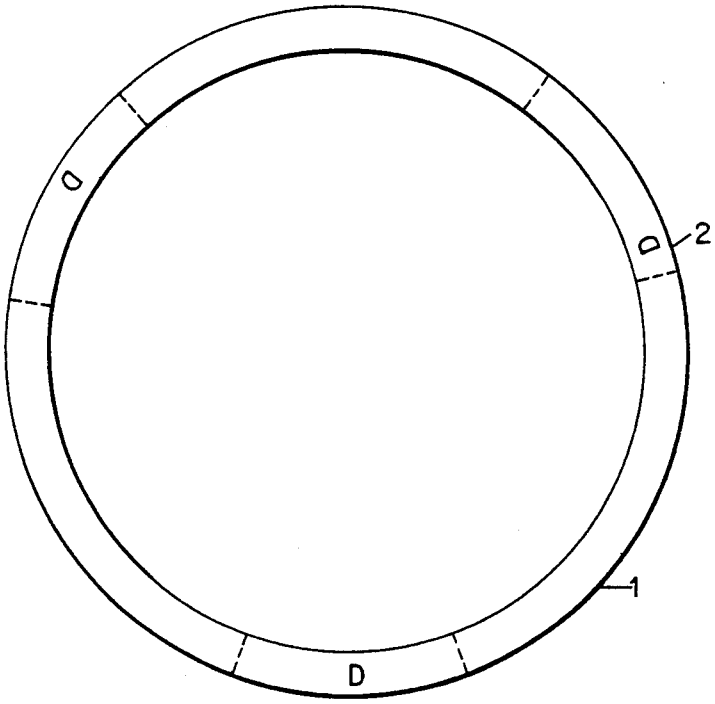
FIG. 2 is a plan view of a first embodiment of the invention.
Figure 3:
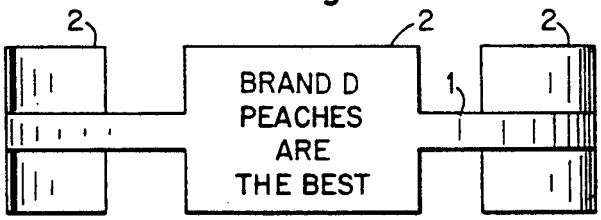
FIG. 3 is a side view of a first embodiment of the invention.

FIGS. 1-3: First Embodiment

Now referring more particularly to FIGS. 1-3 of the accompanying drawings, a first preferred embodiment of the improved can-stacker-information-device of the present invention is schematically depicted therein.

FIG. 1 is a perspective view of a first embodiment of the invention. Although only three "sign/ad" (panel) areas 2 of the ring are shown, it is understood that any number of sign/ad areas are encompassed within the scope of this invention.

Figure 1A:
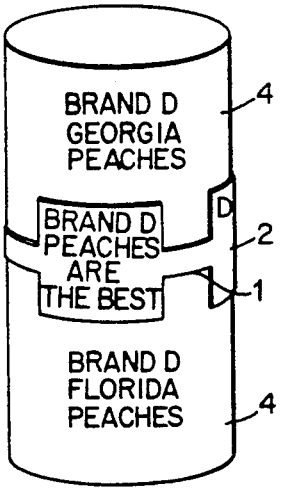
FIG. 1A shows this invention in use.

FIG. 1A is a perspective view of said first embodiment of the invention showing how it may actually be used to simultaneously stack securely two similar-plan-view (circumference/shape) cans 4, as well as to display an ad or other informational message on panel sections 2 of the ring 1 comprising the invention. As is clear from these figures, there are two types of sections comprising the ring. A first "linking" section type, all of which are less than some predetermined vertical dimension, and a second "advertising/information" section type, all of which are greater than said predetermined vertical dimension. Further, each type section is surrounded by and adjacent to only the other type sections, i.e. the first and second type sections alternate around the circumference of the ring. As noted infra, the "advertising/information" can alternatively be on the smaller vertical dimension type section.

Figure 2A:
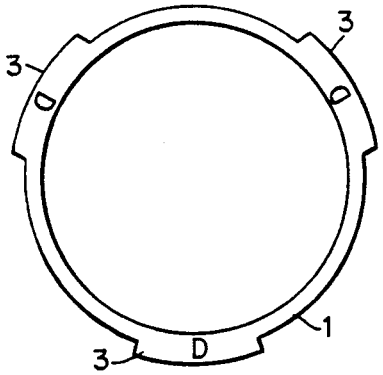
FIG. 2A is a plan view of a variation of said first embodiment of the invention.

FIG. 2 shows a plan view of said first embodiment of the invention. Although the thickness of the ring 1 is shown as being uniform, it is understood that variations in the thickness of the ring at various points in the ring are encompassed within the scope of the invention. That is, for example, the thickness of the ring might be thicker at the ad/sign portions. That is, either generally thicker; or perhaps the thickness increase is cantilevered outward from the general thickness of the ring 1 at the ad/sign portions 3, the latter as shown in FIG. 2A.

Figure 3A:
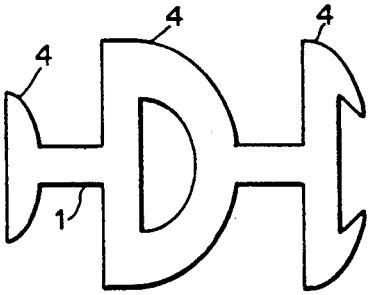
FIG. 3A is a side view of a variation of said first embodiment of the invention.

FIG. 3 shows a side/elevation view of said first embodiment of the invention. It is understood that any panel shape, not merely rectangular, is encompassed within the scope of the invention, for example, the "D" with the hole of the "D" cut out, panels as shown in FIG. 3A.

Figure 4:
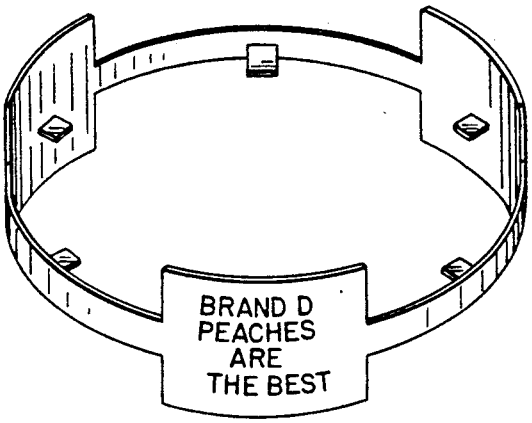
FIG. 4 is a perspective view of a second embodiment of the invention.
Figure 5:
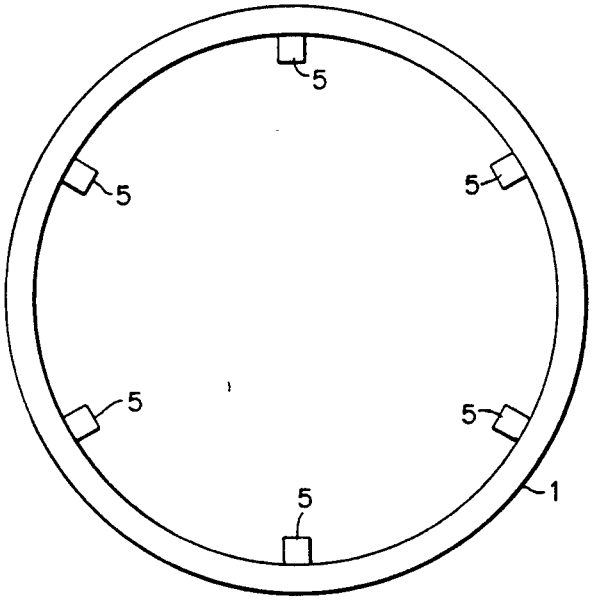
FIG. 5 is a plan view of a second embodiment of the invention.
Figure 6:
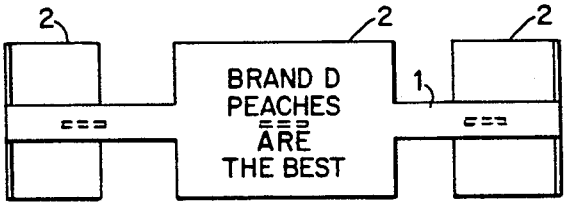
FIG. 6 is a side view of a second embodiment of the invention.

FIGS. 4-6: Second Embodiment

As can be seen from these figures, the ring has an inward-facing side, an outward-facing side, and a "circumference band" of that portion of the ring delineated by those vertical points which at any vertical height go completely around the ring without interruption. This band is thus comprised of portions belonging to each and every section. Further, each section is comprised of a portion of the "circumference band".

FIG. 4 is a perspective view of a second embodiment of the invention. Although only three panel (sign) areas and six horizontally projecting tabs 5 are shown, where each tab projects inward radially from the circumferential vertical ring 1, it is understood that any number and placement of such tabs is encompassed within the scope of the invention. Having panel 2 (sign) areas larger than [i.e. with greater vertical height distance] or smaller than [with smaller vertical height distance] the other, that is, the non-sign portions of the ring, is encompassed within the scope of the invention. The appearance of such second embodiment would physically appear in use substantially the same as in FIG. 1A, but obviously the tabs 5 would separate the vertically secured cans and the tabs would also vertically support the vertically-upper can.

Figure 5A:
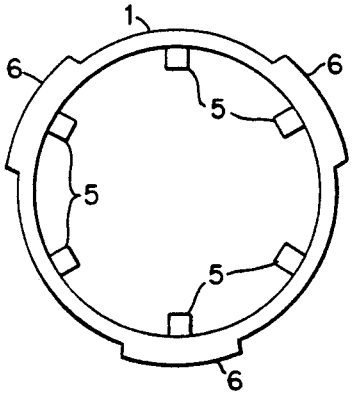
FIG. 5A is a plan view of a variation of said second embodiment of the invention.

FIG. 5 shows a plan view of said second embodiment of the invention. Again, the thickness variations in the ring itself are encompassed within the scope of the invention as are variation in number and placement of the horizontally-inward projecting tabs 5. FIG. 5A shows the panel sign 6 thickness being thicker outward from the general thickness of the ring 1 with one horizontal inward rectangular 5 tab from each sign and each non-sign portion of the ring.

FIG. 6 shows a side view of said second embodiment of the invention and appears the same as FIG. 3.

Figure 6A:
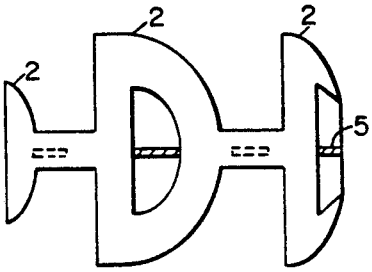
FIG. 6A is a side view of said variation of said second embodiment of the invention.

FIG. 6A, however, shows a side view of said variation of said second embodiment of the invention utilizing the sign concept encompassed in FIG. 3A, where the tab(s) 5 connect and secure the sides of the hole of the "D" as well as serve as tabs. That is, *one* tab 5 may physically be attached or be part of the "D" at its radially-inner side, or two tabs may be connected together to provide endurance and strength to the ring.

Figure 7:
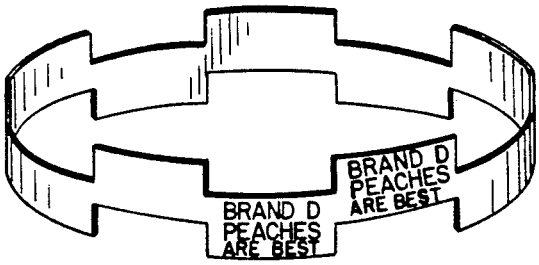
FIG. 7 is a perspective view of a third embodiment of the invention.
Figure 7A:
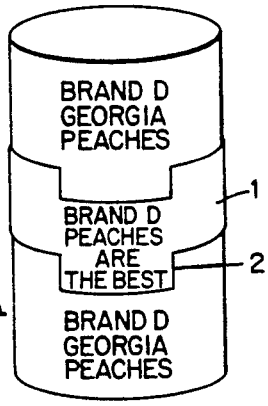
FIG. 7A is a side view of the third embodiment of the invention in use.

FIGS. 7,7A: Third Embodiment

FIG. 7 shows the third embodiment described in the first paragraph of the "Summary of the Invention " as having alternating side panels that go above and the minimal height belt of the ring. Note that said paragraph states that both types of side panels can provide advertising media/instruction space.

FIG. 7A shows the third embodiment of FIG. 7 in use.

FIRST EXTENDED EMBODIMENT

Figure 8A:
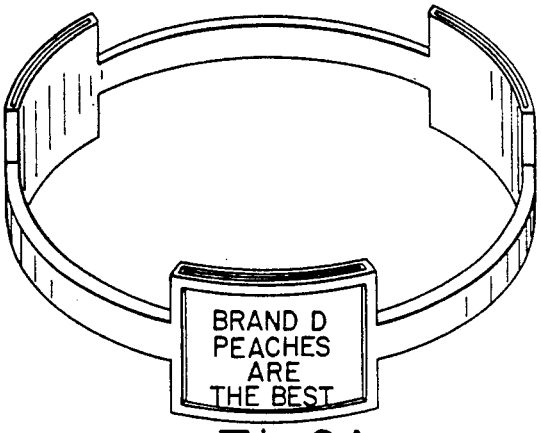
FIG. 8A is a perspective view of an embodiment where the second section contains a slot within which indicia can be inserted from the top, and the front outward-facing face of the second section is windowed.
Figure 8B:
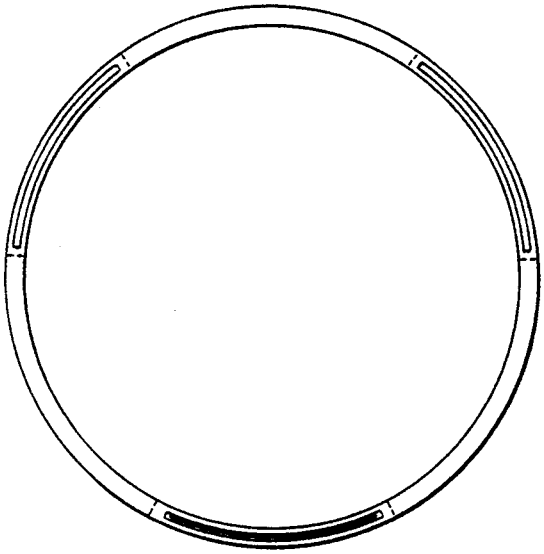
Figure 8C:
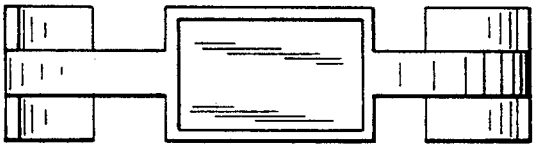
FIG. 8C shows an elevation view of the device of FIG. 8A.

As the manufacturer of the can stacker/advertising-informational device in accordance with the instant invention might not have an order large enough from a single imprinter for a profitable run, the instant invention includes the embodiment to include having at least one second section slotted at its upper interior, with the rectangular aperture leading to the void of the upper interior being at the upper surface (horizontal) of the second section, as shown in perspective in FIG. 8A, in plan view in FIG. 8B, and in elevation view in FIG. 8C.

As shown in those figures, this permits a can stacker-/advertising ring that can be mass produced without need for customizing in manufacture, but which is customized by means of inserting an appropriate panel of advertising or information indicia whicj can be inserted in the slot and willingly removable at a later date.

SECOND EXTENDED EMBODIMENT

Another version of the framed slot associated with one of the first or second sections is comprised of 2 opposing guideways and a stop which cooperate to securably hold a panel of indicia, advertising, instructions, information, coupons, etc.; and is basically a three-sided frame molded simultaneously onto the outward-facing side of one of said sections. (It could also be attached to a first section).

Figure 9:
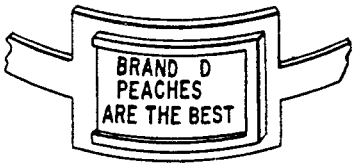
FIG. 9 shows a 3-sided frame formed on the outward-facing portion of a second section, wherein indicia can be slided in, in a horizontal fashion.

A horizontal embodiment is shown in FIG. 9.

Figure 10:
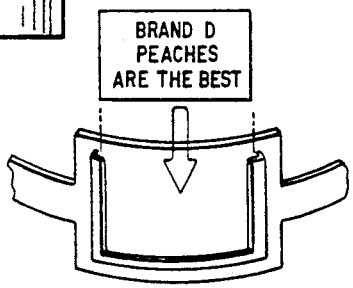
FIG. 10 shows the 3-sided frame concept of FIG. 9, but where the frame which is formed on the outward-facing side of a second section is oriented to receive indicia in a vertical direction.

A vertical embodiment is shown in FIG. 10. The information panel can be any of a piece of paper, stiff paper, thin plastic, cardboard, metal, etc.

THIRD EXTENDED EMBODIMENT

It should be easily understood that consumer food can sellers would desire to obtain or increase market share by distributing the cupboard-organizing can stacker/advertising device of the instant invention to the general public and probably at no charge. As an additional incentive for the public to accept (and use) the can stacker and the inherent (or attached or included within a frame) advertising, the can distributor or manufacturer might also desire to attach a coupon or token. The coupon might relate to a discount as to the certain goods or furure goods, or have information of some value i.e. perhaps to list emergency numbers, poison control centers, lobbying information, promotional information, or anything that might be useful if detachable from on of said first or second sections of said ring. Detachableness can be achieved by having the "coupon panel" have merely a weakened or less thick connecting member between said panel and the connecting section.

Figure 11B:
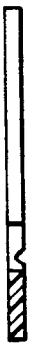
FIG. 11B shows a sectional view of the panel and the weakened portion formed during thermoplastic or other formation of the device—the weakening facilitating detachability by manual manipulation.
Figure 11A:
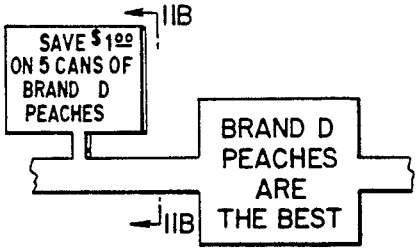
FIG. 11A shows a device in accordance with the instant invention having a detachable panel.

Such an example is shown in FIG. 11, where a detachable coupon is shown detachably attached to a first section. By bending the coupon panel back and forth repeatedly, or by twisting the panel repeatedly with some force, the panel will break away when the weakened area finally fatigures permitting breaking at the weakened area of the connecting volume between the panel and the connecting section.

FOURTH EXTENDED EMBODIMENT

Figure 12:
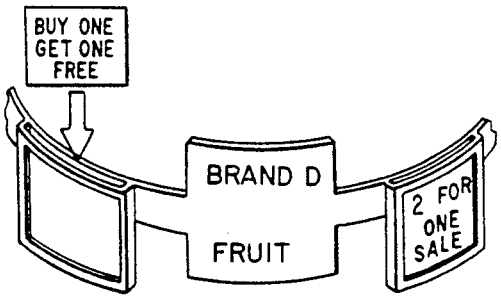
FIG. 12 shows an embodiment of the instant invention wherein a pocket for insertion of indicia is made apart of one such first or second type section, or may be attached thereafter by some adhesive or thermoplastic or heat attaching means.
Figure 13:
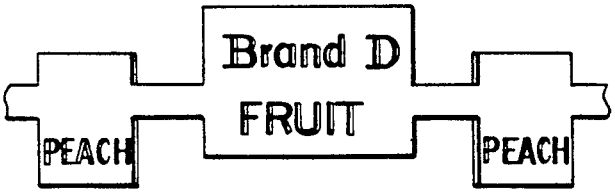
FIG. 13 shows indicia formed on said second sections creating a 3-D effect, and eliminates separate ink-type imprinting.

When binary chemicals in cans are secured together by means of a combination can stacker/advertising-informational device of the present invention, the instructions for the proper mixture or processing may be complex and lengthy. Or; perhaps the can distributor of retail goods desires to distribute literature or multiple coupons. In each of these cases, the amount of information or number of pages desired to be distributed exceeds the capacity of any reasonable can stacker/advertising-informational device per se, and thus creates the necessity for a carrier or pocket to be formed with and physically attached to part of one of the sections of said can stacker/advertising-information device. FIG. 12 shows one embodiment of such a ring having an integral pocket attached to and part physically connected to one of said sections, said pocket being of such dimensions such that a long informational sheet or multiple sheets, or other special situation can be accomodated, by inserting such information in the pocket prior to distribution of the device.

FIFTH EXTENDED EMBODIMENT

As the primary manufacturing process involved herein is usually thermoplastic forming or heat combined with some form of stamping process, it may be more economically efficient to eliminate any ink imprinting on either a second section or the detachable panel/coupon section, but still to maintain readablity. This can be achieved by forming the indicia information on/as a part of the front-facing portion of said sections as part of the thermoplastic forming or heat stamping process, which would give the indicia a three-dimensional effect.

What is claimed is:

1. A combination can stacker/advertising-informational device comprising:

a flexible resilient ring having a circumference, an inward-facing side and an outward-facing side, said ring including at least one first type section having a vertical dimension, and at least one second type section having a vertical dimension; each second type section having said vertical dimension greater than the vertical dimension of each said first type section; said first and second sections alternating along the circumference of said ring, at least one said second section comprising a back, a 3-sided frame, and a windowed front; said frame comprising 2 opposing sides and a side which is non-opposing, but is physically connected to the opposing sides; said back and front opposing each other, said back being inward facing, said front being outward facing, and said frame physically joining and connecting said front and back; said 3-sided frame, front, and back foring an enclosed void within which said 2 opposing sides of said 3-sided frame serves as opposing guideways for the reception of information panels with said non-opposing side serving as a stop for said panel, said second section having said frame permitting removability of said panel at will;

at least one said second type section having said frame further permitting the insertion and removal of said information panels, said panels viewable on the outward-facing side of said ring; said ring permitting vertical stacking of cans; said panels having indicia thereon.

2. The device of claim 1, further comprising at least one third type section, each said third type section comprising a horizontal tab pointing radially inward from said ring; each said tab separating and vertically supporting a can placed into said device from above said ring.

3. A combination can stacker/advertising-informational device comprising:

a flexible resilient ring having a circumference, an inward-facing side and an outward facing side; said ring including at least one first type section having a vertical dimension, and at least one second type section having a vertical dimension, each second type section having said vertical dimension greater than the vertical dimension of each said first type section; said first and second sections alternating along the circumference of said ring;

at least one second section comprising a back and a 3-sided frame, said back being inward-facing, said frame comprising 2 opposing sides and a non-opposing side which is physically connected to said opposing sides, said frame forming a slide holder having 2 opposing sides serving as guideways for the reception of an information/advertising panel, said non-opposing side serving as a securing stop for said panel, said frame securing said panel within upon its insertion, but permitting removability of said panel at will;

at least one said second section having said frame permitting the insertion and removal of panels having indicia thereon, viewable on the outward-facing side of said ring;

said ring permitting vertical stacking of cans, and said indicia for providing information.

4. The device of claim 3, further comprising at least one third type section, each said third type section comprising a horizontal tab pointing radially inward from said ring; each said tab separating and vertically supporting a can placed into said device from above said ring.

5. A combination can stacker/advertising-informational device comprising:

a flexible resilient ring having a circumference, an inward-facing side and an outward-facing side, said ring including at least one first type section having a vertical dimension, and at least one second type section having a vertical dimension, each said second type section having said vertical dimension greater than the vertical dimension of each said first type section, said first and second sections alternating along the circumference of said ring, said ring further comprising at least one panel section detachably connected to one of said first or second sections, said panel section having indicia stamped/formed thereon, said ring permitting vertical stacking of cans.

6. The device of claim 5, further comprising at least one third type section, each said third type section comprising a horizontal tab pointing radially inward from said ring, each said tab separating and vertically supporting a can placed into said device from above said ring.

7. The device of claim 5 whereby said indicia is a coupon.

8. The device of claim 6, said indicia formed of solid characters, designs, and the like; said indicia thus of three-dimensional effect.

9. The device of claim 7, further comprising at least one third type section, each said third type section comprising a horizontal tab pointing radially inward from said ring, each said tab separating and vertically supporting a can placed into said device from above said ring.

10. A combination can stacker/advertising-informational device comprising:

a flexible resilient ring having a circumference, an inward-facing side and an outward-facing side, said ring including at least one first type section having a vertical dimension, and at least one second typ section having a vertical dimension, each second type section having said vertical dimension greater than the vertical dimension of each said first type section, each said first and second type sections alternating along the circumference of said ring;

said device further comprising a pocket attached to one of said first or second sections; said pocket holding indicia;

said ring permitting vertical stacking of cans.

* * * * *